US008088213B2

(12) United States Patent
Cheng et al.

(10) Patent No.: US 8,088,213 B2
(45) **Date of Patent: *Jan. 3, 2012**

(54) CONTROLLABLE FILLER PREFLOCULATION USING A DUAL POLYMER SYSTEM

(75) Inventors: Weiguo Cheng, Naperville, IL (US); Ross T. Gray, Plainfield, IL (US)

(73) Assignee: Nalco Company, Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/431,356

(22) Filed: Apr. 28, 2009

(65) Prior Publication Data

US 2009/0267258 A1 Oct. 29, 2009

Related U.S. Application Data

(63) Continuation-in-part of application No. 11/854,044, filed on Sep. 12, 2007.

(51) Int. Cl.
*C09C 3/00* (2006.01)
*C09C 1/02* (2006.01)
*C09C 1/42* (2006.01)

(52) U.S. Cl. ..... 106/416; 106/401; 106/448; 106/461; 106/499

(58) Field of Classification Search ..... 106/401, 106/416, 448, 461, 499
See application file for complete search history.

(56) References Cited

U.S. PATENT DOCUMENTS 4,569,768 A * 2/1986 McKinley ..... 210/727
4,799,964 A 1/1989 Harvey et al.
4,889,594 A 12/1989 Gavelin
4,925,530 A * 5/1990 Sinclair et al. ..... 162/168.1
4,943,349 A 7/1990 Gomez
5,017,268 A * 5/1991 Clitherow et al. ..... 162/146
5,098,520 A * 3/1992 Begala ..... 162/183
5,185,135 A * 2/1993 Pillai et al. ..... 423/320
5,244,542 A * 9/1993 Bown et al. ..... 162/164.3
5,759,346 A * 6/1998 Vinson ..... 162/164.1
5,779,859 A * 7/1998 Carter et al. ..... 162/183
6,313,246 B1 * 11/2001 Carter et al. ..... 526/258
6,444,091 B1 * 9/2002 Ward et al. ..... 162/164.1
6,524,439 B2 2/2003 Chen et al.

(Continued)

FOREIGN PATENT DOCUMENTS

CA 1306084 8/1992

(Continued)

OTHER PUBLICATIONS

Bobu, E. *Cell. Chem. Technol.* "Preflocculated Calcium Carbonate for Filling Paper." vol. 20, No. 5 (1986). pp. 559-566.

(Continued)

*Primary Examiner* — Matthew Daniels
*Assistant Examiner* — Dennis Cordray
(74) *Attorney, Agent, or Firm* — Benjamin E. Carlsen; Michael B. Martin

(57) ABSTRACT

A method of preparing a stable dispersion of flocculated filler particles for use in papermaking processes comprises sequential addition of a first flocculating agent to an aqueous dispersion of filler particles followed by shearing of the dispersion, followed by addition of a second flocculating agent to the dispersion and further shearing of the resultant filler flocs to the desired particle size resulting in shear resistant filler flocs with a defined and controllable size distribution. In addition, a neutralizing coagulant can be added to the dispersion to partially or completely neutralize the charge of the filler before the first flocculating agent is added.

14 Claims, 1 Drawing Sheet

U.S. PATENT DOCUMENTS

| | | | | |
|---|---|---|---|---|
| 2006/0084772 | A1 * | 4/2006 | Wong Shing et al. | 526/217 |
| 2009/0020250 | A1 * | 1/2009 | Kimura et al. | 162/164.6 |

FOREIGN PATENT DOCUMENTS

| | | | |
|---|---|---|---|
| EP | 0227853 | B1 | 5/1993 |
| JP | 61063796 | | 4/1986 |
| WO | WO 2004/098782 | | 11/2004 |

OTHER PUBLICATIONS

Ono, H. "Cationic Microparticle Retention Aids: Mechanism Study and Laboratory Evaluation", *IPST: Technical Paper Series*. 632 (Atlanta, GA) p. 20.

Mabee, Stuart. "Controlled Filler Preflocculation—Improved Formation, Strength and Machine Performance." *TAPPI Papermakers Conf*. (2001) pp. 1129-1136.

Petzold, G. "Higher efficiency in the flocculation of clay suspensions by using combinations of oppositely charged polyelectrolytes." *Colloids and Surfaces*. 218 (2003) 47-57.

Seppanen R. "Microfloc formation of fillers." *Paper presented at EUCEPA International Symposium: Additives, Pigments and fillers in the Pulp and Paper Industry*. (1990) pp. 22-24.

Yoon, S. and Deng, Y. "Flocculation and reflocculation of clay suspension by different polymer systems under turbulent conditions, " *Colloids and Interface Science*. 278 (2004) 139-145.

* cited by examiner

CONTROLLABLE FILLER PREFLOCULATION USING A DUAL POLYMER SYSTEM

CROSS-REFERENCE TO RELATED APPLICATIONS

This application is a Continuation-in-part of pending U.S. patent application Ser. No. 11/854,044 filed on Sep. 12, 2007.

STATEMENT REGARDING FEDERALLY SPONSORED RESEARCH OR DEVELOPMENT

Not Applicable.

BACKGROUND OF THE INVENTION

This invention relates to the preflocculation of fillers used in papermaking, particularly, the production of shear resistant filler flocs with a defined and controllable size distribution at high filler solids is disclosed.

Increasing the filler content in printing and writing papers is of great interest for improving product quality as well as reducing raw material and energy costs. However, the substitution of cellulose fibers with fillers like calcium carbonate and clay reduces the strength of the finished sheet. Another problem when the filler content is increased is an increased difficulty of maintaining an even distribution of fillers across the three-dimensional sheet structure. An approach to reduce these negative effects of increasing filler content is to preflocculate fillers prior to their addition to the wet end approach system of the paper machine.

The definition of the term "preflocculation" is the modification of filler particles into agglomerates through treatment with coagulants and/or flocculants. The flocculation treatment and shear forces of the process determine the size distribution and stability of the flocs prior to addition to the paper stock. The chemical environment and high fluid shear rates present in modern high-speed papermaking require filler flocs to be stable and shear resistant. The floe size distribution provided by a preflocculation treatment should minimize the reduction of sheet strength with increased filler content, minimize the loss of optical efficiency from the filler particles, and minimize negative impacts on sheet uniformity and printability. Furthermore, the entire system must be economically feasible.

Therefore, the combination of high shear stability and sharp particle size distribution is vital to the success of filler preflocculation technology. However, filler flocs formed by a low molecular weight coagulant alone, including commonly used starch, tend to have a relatively small particle size that breaks down under the high shear forces of a paper machine. Filler flocs formed by a single high molecular weight flocculant tend to have a broad particle size distribution that is difficult to control, and the particle size distribution gets worse at higher filler solids levels, primarily due to the poor mixing of viscous flocculent solution into the slurry. Accordingly, there is an ongoing need for improved preflocculation technologies.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

At least one embodiment is directed towards a method of preparing a stable dispersion of flocculated filler particles having a specific particle size distribution for use in papermaking processes comprising a) providing an aqueous dispersion of filler particles; b) adding a first flocculating agent to the dispersion in an amount sufficient to mix uniformly in the dispersion without causing significant flocculation of the filler particles; c) adding a second flocculating agent to the dispersion in an amount sufficient to initiate flocculation of the filler particles in the presence of the first flocculating agent; and d) optionally shearing the flocculated dispersion to provide a dispersion of filler flocs having the desired particle size.

At least one embodiment is directed towards a method of making paper products from pulp comprising forming an aqueous cellulosic papermaking furnish, adding an aqueous dispersion of filler flocs prepared as described herein to the furnish, draining the furnish to form a sheet and drying the sheet. The steps of forming the papermaking furnish, draining and drying may be carried out in any conventional manner generally known to those skilled in the art.

At least one embodiment is directed towards a paper product incorporating the filler flocs prepared as described herein.

BRIEF DESCRIPTION OF THE DRAWINGS

A detailed description of the invention is hereafter described with specific reference being made to the drawings in which.

DETAILED DESCRIPTION OF THE INVENTION

Figure 1:
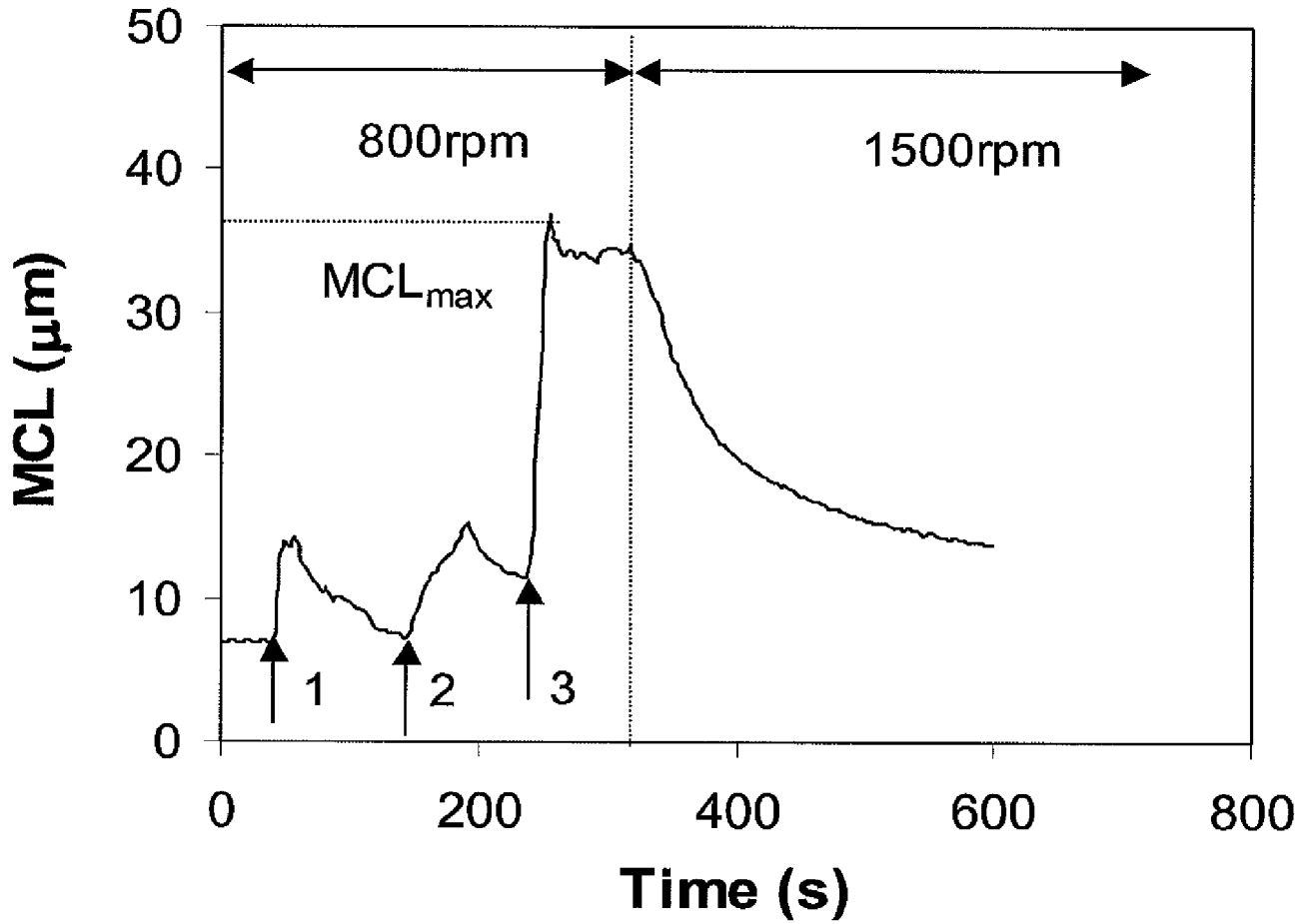
FIG. 1 is an illustration of an MCL time resolution of a flocculating reaction.

For purposes of this application the definition of these terms is as follows:

"Coagulant" means a composition of matter having a higher charge density and lower molecular weight than a flocculent, which when added to a liquid containing finely divided suspended particles, destabilizes and aggregates the solids through the mechanism of ionic charge neutralization.

"Flocculant" means a composition of matter having a low charge density and a high molecular weight (in excess of 1,000,000) which when added to a liquid containing finely divided suspended particles, destabilizes and aggregates the solids through the mechanism of interparticle bridging.

"Flocculating Agent" means a composition of matter which when added to a liquid destabilizes, and aggregates colloidal and finely divided suspended particles in the liquid, flocculants and coagulants can be flocculating agents.

"GCC" means ground calcium carbonate, which is manufactured by grinding naturally occurring calcium carbonate rock "PCC" means precipitated calcium carbonate which is synthetically produced.

The fillers useful in this invention are well known and commercially available. They typically would include any inorganic or organic particle or pigment used to increase the opacity or brightness, increase the smoothness, or reduce the cost of the paper or paperboard sheet. Representative fillers include calcium carbonate, kaolin clay, talc, titanium dioxide, alumina trihydrate, barium sulfate, magnesium hydroxide, and the like. Calcium carbonate includes GCC in a dry or dispersed slurry form, chalk, PCC of any morphology, and PCC in a dispersed slurry form. Some examples of GCC and PCC slurries are provided in co-pending U.S. patent application Ser. No. 12/323,976. The dispersed slurry forms of GCC or PCC are typically produced using polyacrylic acid polymer dispersants or sodium polyphosphate dispersants. Each of these dispersants imparts a significant anionic charge to the calcium carbonate particles. Kaolin clay slurries may also be dispersed using polyacrylic acid polymers or sodium polyphosphate.

In an embodiment, the fillers are selected from calcium carbonate and kaolin clay and combinations thereof.

In an embodiment, the fillers are selected from precipitated calcium carbonate, ground calcium carbonate and kaolin clay, and mixtures thereof.

The first flocculating agent is preferably a cationic polymeric flocculant when used with cationically charged fillers and anionic when used with anionically charged fillers. However, it can be anionic, nonionic, zwitterionic, or amphoteric as long as it will mix uniformly into a high solids slurry without causing significant flocculation.

The definition of "without causing significant flocculation" is no flocculation of the filler in the presence of the first flocculating agent or the formation of flocs which are smaller than those produced upon addition of the second flocculating agent and unstable under conditions of moderate shear. Moderate shear is defined as the shear provided by mixing a 300 ml sample in a 600 ml beaker using an IKA RE16 stirring motor at 800 rpm with a 5 cm diameter, four-bladed, turbine impeller. This shear should be similar to that present in the approach system of a modern paper machine.

Suitable flocculants generally have molecular weights in excess of 1,000,000 and often in excess of 5,000,000.

The polymeric flocculant is typically prepared by vinyl addition polymerization of one or more cationic, anionic or nonionic monomers, by copolymerization of one or more cationic monomers with one or more nonionic monomers, by copolymerization of one or more anionic monomers with one or more nonionic monomers, by copolymerization of one or more cationic monomers with one or more anionic monomers and optionally one or more nonionic monomers to produce an amphoteric polymer or by polymerization of one or more zwitterionic monomers and optionally one or more nonionic monomers to form a zwitterionic polymer. One or more zwitterionic monomers and optionally one or more nonionic monomers may also be copolymerized with one or more anionic or cationic monomers to impart cationic or anionic charge to the zwitterionic polymer. Suitable flocculants generally have a charge content of less than 80 mole percent and often less than 40 mole percent.

While cationic polymer flocculants may be formed using cationic monomers, it is also possible to react certain nonionic vinyl addition polymers to produce cationically charged polymers. Polymers of this type include those prepared through the reaction of polyacrylamide with dimethylamine and formaldehyde to produce a Mannich derivative.

Similarly, while anionic polymer flocculants may be formed using anionic monomers, it is also possible to modify certain nonionic vinyl addition polymers to form anionically charged polymers. Polymers of this type include, for example, those prepared by the hydrolysis of polyacrylamide.

The flocculant may be prepared in the solid form, as an aqueous solution, as a water-in-oil emulsion, or as a dispersion in water. Representative cationic polymers include copolymers and terpolymers of (meth)acrylamide with dimethylaminoethyl methacrylate (DMAEM), dimethylaminoethyl acrylate (DMAEA), diethylaminoethyl acrylate (DAEA), diethylaminoethyl methacrylate (DEAEM) or their quaternary ammonium forms made with dimethyl sulfate, methyl chloride or benzyl chloride. Representative anionic polymers include copolymers of acrylamide with sodium acrylate and/or 2-acrylamido 2-methylpropane sulfonic acid (AMPS) or an acrylamide homopolymer that has been hydrolyzed to convert a portion of the acrylamide groups to acrylic acid.

In an embodiment, the flocculants have a RSV of at least 3 dL/g.

In an embodiment, the flocculants have a RSV of at least 10 dL/g.

In an embodiment, the flocculants have a RSV of at least 15 dL/g.

As used herein, "RSV" stands for reduced specific viscosity. Within a series of polymer homologs which are substantially linear and well solvated, "reduced specific viscosity (RSV)" measurements for dilute polymer solutions are an indication of polymer chain length and average molecular weight according to *Determination of Molecular Weights*, by Paul J. Flory, pages 266-316, *Principles of Polymer Chemistry*, Cornell University Press, Ithaca, NY, Chapter VII (1953). The RSV is measured at a given polymer concentration and temperature and calculated as follows:

$RSV=[(\eta/\eta_o)-1]/c$ where $\eta$=viscosity of polymer solution, $\eta_o$=viscosity of solvent at the same temperature and c=concentration of polymer in solution.

The units of concentration "c" are (grams/100 ml or g/deciliter). Therefore, the units of RSV are dL/g. Unless otherwise specified, a 1.0 molar sodium nitrate solution is used for measuring RSV. The polymer concentration in this solvent is 0.045 g/dL. The RSV is measured at 30° C. The viscosities $\eta$ and $\eta_o$ are measured using a Cannon Ubbelohde semi-micro dilution viscometer, size 75. The viscometer is mounted in a perfectly vertical position in a constant temperature bath adjusted to 30±0.02° C. The typical error inherent in the calculation of RSV for the polymers described herein is about 0.2 dL/g. When two polymer homologs within a series have similar RSV's that is an indication that they have similar molecular weights.

As discussed above, the first flocculating agent is added in an amount sufficient to mix uniformly in the dispersion without causing significant flocculation of the filler particles. In an embodiment, the first flocculating agent dose is between 0.2 and 6.0 lb/ton of filler treated. In an embodiment, the flocculant dose is between 0.4 and 3.0 lb/ton of filler treated. For purposes of this invention, "lb/ton" is a unit of dosage that means pounds of active polymer (coagulant or flocculant) per 2,000 pounds of filler.

The second flocculating agent can be any material that can initiate the flocculation of filler in the presence of the first flocculating agent. In an embodiment, the second flocculating agent is selected from microparticles, coagulants, flocculants and mixtures thereof.

Suitable microparticles include siliceous materials and polymeric microparticles. Representative siliceous materials include silica based particles, silica microgels, colloidal silica, silica sols, silica gels, polysilicates, cationic silica, aluminosilicates, polyaluminosilicates, borosilicates, polyborosilicates, zeolites, and synthetic or naturally occurring swelling clays. The swelling clays may be bentonite, hectorite, smectite, montmorillonite, nontronite, saponite, sauconite, mormite, attapulgite, and sepiolite.

Polymeric microparticles useful in this invention include anionic, cationic, or amphoteric organic microparticles. These microparticles typically have limited solubility in water, may be crosslinked, and have an unswollen particle size of less than 750 nm.

Anionic organic microparticles include those described in U.S. Pat. No. 6,524,439 and made by hydrolyzing acrylamide polymer microparticles or by polymerizing anionic monomers as (meth)acrylic acid and its salts, 2-acrylamido-2-methylpropane sulfonate, sulfoethyl-(meth)acrylate, vinylsulfonic acid, styrene sulfonic acid, maleic or other dibasic acids or their salts or mixtures thereof. These anionic monomers may also be copolymerized with nonionic monomers such as (meth)acrylamide, N-alkylacrylamides, N,N-dialkylacrylamides, methyl (meth)acrylate, acrylonitrile, N-vinyl methylacetamide, N-vinyl methyl formamide, vinyl acetate, N-vinyl pyrrolidone, and mixtures thereof.

Cationic organic microparticles include those described in U.S. Pat. No. 6,524,439 and made by polymerizing such monomers as diallyldialkylammonium halides, acryloxyalkyltrimethylammonium chloride, (meth)acrylates of dialkylaminoalkyl compounds, and salts and quaternaries thereof and, monomers of N,N-dialkylaminoalkyl(meth) acrylamides, (meth)acrylamidopropyltrimethylammonium chloride and the acid or quaternary salts of N,N-dimethylaminoethylacrylate and the like. These cationic monomers may also be copolymerized with nonionic monomers such as (meth)acrylamide, N-alkylacrylamides, N,N-dialkylacrylamides, methyl(meth)acrylate, acrylonitrile, N-vinyl methylacetamide, N-vinyl methyl formamide, vinyl acetate, N-vinyl pyrrolidone, and mixtures thereof.

Amphoteric organic microparticles are made by polymerizing combinations of at least one of the anionic monomers listed above, at least one of the cationic monomers listed above, and, optionally, at least one of the nonionic monomers listed above.

Polymerization of the monomers in an organic microparticle typically is done in the presence of a polyfunctional crosslinking agent. These crosslinking agents are described in U.S. Pat. No. 6,524,439 as having at least two double bonds, a double bond and a reactive group, or two reactive groups. Examples of these agents are N,N-methylenebis(meth)acrylamide, polyethyleneglycol di(meth)acrylate, N-vinyl acrylamide, divinylbenzene, triallylammonium salts, N-methylallylacrylamide glycidyl(meth)acrylate, acrolein, methylolacrylamide, dialdehydes like glyoxal, diepoxy compounds, and epichlorohydrin.

In an embodiment, the microparticle dose is between 0.5 and 8 lb/ton of filler treated. In an embodiment, the microparticle dose is between 1.0 and 4.0 lb/ton of filler treated.

Suitable coagulants generally have lower molecular weight than flocculants and have a high density of cationic charge groups. The coagulants useful in this invention are well known and commercially available. They may be inorganic or organic. Representative inorganic coagulants include alum, sodium aluminate, polyaluminum chlorides or PACs (which also may be under the names aluminum chlorohydroxide, aluminum hydroxide chloride, and polyaluminum hydroxychloride), sulfated polyaluminum chlorides, polyaluminum silica sulfate, ferric sulfate, ferric chloride, and the like and blends thereof.

Many organic coagulants are formed by condensation polymerization. Examples of polymers of this type include epichlorohydrin-dimethylamine (EPI-DMA) copolymers, and EPI-DMA copolymers crosslinked with ammonia.

Additional coagulants include polymers of ethylene dichloride and ammonia, or ethylene dichloride and dimethylamine, with or without the addition of ammonia, condensation polymers of multifunctional amines such as diethylenetriamine, tetraethylenepentamine, hexamethylenediamine and the like with ethylenedichloride or polyfunctional acids like adipic acid and polymers made by condensation reactions such as melamine formaldehyde resins.

Additional coagulants include cationically charged vinyl addition polymers such as polymers, copolymers, and terpolymers of (meth)acrylamide, diallyl-N,N-disubstituted ammonium halide, dimethylaminoethyl methacrylate and its quaternary ammonium salts, dimethylaminoethyl acrylate and its quaternary ammonium salts, methacrylamidopropyltrimethylammonium chloride, diallylmethyl(beta-propionamido)ammonium chloride, (beta-methacryloyloxyethyl)trimethyl ammonium methylsulfate, quaternized polyvinyllactam, vinylamine, and acrylamide or methacrylamide that has been reacted to produce the Mannich or quaternary Mannich derivatives. Suitable quaternary ammonium salts may be produced using methyl chloride, dimethyl sulfate, or benzyl chloride. The terpolymers may include anionic monomers such as acrylic acid or 2-acrylamido 2-methylpropane sulfonic acid as long as the overall charge on the polymer is cationic. The molecular weights of these polymers, both vinyl addition and condensation, range from as low as several hundred to as high as several million.

Other polymers useful as the second flocculating agent include cationic, anionic, or amphoteric polymers whose chemistry is described above as a flocculant. The distinction between these polymers and flocculants is primarily molecular weight.

The second flocculating agent may be used alone or in combination with one or more additional second flocculating agents. In an embodiment, one or more microparticles are added to the flocculated filler slurry subsequent to addition of the second flocculating agent.

The second flocculating agent is added to the dispersion in an amount sufficient to initiate flocculation of the filler particles in the presence of the first flocculating agent. In an embodiment, the second flocculating agent dose is between 0.2 and 8.0 lb/ton of filler treated. In an embodiment, the second component dose is between 0.5 and 6.0 lb/ton of filler treated.

In an embodiment, one or more microparticles may be added to the flocculated dispersion prior to shearing to provide additional flocculation and/or narrow the particle size distribution.

In an embodiment, the second flocculating agent and first flocculating agent are oppositely charged.

In an embodiment, the first flocculating agent is cationic and the second flocculating agent is anionic.

In an embodiment, the first flocculating agent is selected from copolymers of acrylamide with dimethylaminoethyl methacrylate (DMAEM) or dimethylaminoethyl acrylate (DMAEA) and mixtures thereof.

In an embodiment, the first flocculating agent is an acrylamide and dimethylaminoethyl acrylate (DMAEA) copolymer with a cationic charge content of 5-50 mole % and an RSV of >15 dL/g.

In an embodiment, the second flocculating agent is selected from the group consisting of partially hydrolyzed acrylamide and copolymers of acrylamide and sodium acrylate.

In an embodiment, the second flocculating agent is acrylamide-sodium acrylate copolymer having an anionic charge of 5-40 mole percent and a RSV of 0.3-5 dL/g.

In an embodiment, the first flocculating agent is anionic and the second flocculating agent is cationic.

In an embodiment, the first flocculating agent is selected from the group consisting of partially hydrolyzed acrylamide and copolymers of acrylamide and sodium acrylate.

In an embodiment, the first flocculating agent is a copolymer of acrylamide and sodium acrylate having an anionic charge of 5-75 mole percent and an RSV of at least 15 dL/g.

In an embodiment, the second flocculating agent is selected from the group consisting of epichlorohydrin-dimethylamine (EPI-DMA) copolymers, EPI-DMA copolymers crosslinked with ammonia, and homopolymers of diallyl-N,N-disubstituted ammonium halides.

In an embodiment, the second flocculating agent is a homopolymer of diallyl dimethyl ammonium chloride having an RSV of 0.1-2 dl/g.

In an embodiment, the second flocculating agent is selected from copolymers of acrylamide with dimethylaminoethyl methacrylate (DMAEM) or dimethylaminoethyl acrylate (DMAEA) and mixtures thereof.

In an embodiment, the second flocculating agent is an acrylamide and dimethylaminoethyl acrylate (DMAEA) copolymer with a cationic charge content of 5-50 mole % and an RSV of >15 dL/g.

Dispersions of filler flocs according to this invention are prepared prior to their addition to the papermaking furnish. This can be done in a batch-wise or continuous fashion. The filler concentration in these slurries is typically less than 80% by mass. It is more typically between 5 and 65% by mass.

A batch process can consist of a large mixing tank with an overhead, propeller mixer. The filler slurry is charged to the mix tank, and the desired amount of first flocculating agent is fed to the slurry under continuous mixing. The slurry and flocculent are mixed for an amount of time sufficient to distribute the first flocculating agent uniformly throughout the system, typically for about 10 to 60 seconds, depending on the mixing energy used. The desired amount of second flocculating agent is then added while stirring at a mixing speed sufficient to break down the filler flocs with increasing mixing time typically from several seconds to several minutes, depending on the mixing energy used. Optionally, a microparticle is added as a third component to cause reflocculation and narrow the floe size distribution. When the appropriate size distribution of the filler flocs is obtained, the mixing speed is lowered to a level at which the flocs are stable. This batch of flocculated filler is then transferred to a larger mixing tank with sufficient mixing to keep the filler flocs uniformly suspended in the dispersion. The flocculated filler is pumped from this mixing tank into the papermaking furnish.

In a continuous process the desired amount of first flocculating agent is pumped into the pipe containing the filler and mixed with an in-line static mixer, if necessary. A length of pipe or a mixing vessel sufficient to permit adequate mixing of filler and flocculant may be included prior to the injection of the appropriate amount of second flocculating agent. The second flocculating agent is then pumped into the pipe containing the filler and mixed with an in-line static mixer, if necessary. Optionally, a microparticle is added as a third component to cause reflocculation and narrow the floc size distribution. High speed mixing is then required to obtain the desired size distribution of the filler flocs. Adjusting either the shear rate of the mixing device or the mixing time can control the floc size distribution. A continuous process would lend itself to the use of an adjustable shear rate in a fixed volume device. One such device is described in U.S. Pat. No. 4,799,964. This device is an adjustable speed centrifugal pump that when operated at a back pressure exceeding its shut off pressure, works as a mechanical shearing device with no pumping capacity. Other suitable shearing devices include a nozzle with an adjustable pressure drop, a turbine-type emulsification device, or an adjustable speed, high intensity mixer in a fixed volume vessel. After shearing, the flocculated filler slurry is fed directly into the papermaking furnish.

In both the batch and continuous processes described above, the use of a filter or screen to remove oversize filler flocs can be used. This eliminates potential machine runnability and paper quality problems resulting from the inclusion of large filler flocs in the paper or board.

In an embodiment, the median particle size of the filler flocs is at least 10 μm. In an embodiment, the median particle size of the filler flocs is between 10 and 100 μm. In an embodiment, the median particle size of the filler flocs is between 10 and 70 μM.

The foregoing may be better understood by reference to the following Examples, which are presented for purposes of illustration and are not intended to limit the scope of the invention.

EXAMPLES 1-7

The filler used for each example was either undispersed or dispersed, scalenohedral PCC (available as Albacar HO from Specialty Minerals Inc., Bethlehem, Pa. USA). When undispersed PCC is used, the dry product was diluted to 10% solids using tap water. When dispersed PCC was used, it was obtained as 40% solids slurry and is diluted to 10% solids using tap water. The size distribution of the PCC was measured at three second intervals during flocculation using a Lasentec® S400 FBRM (Focused Beam Reflectance Measurement) probe, manufactured by Lasentec, Redmond, Wash. A description of the theory behind the operation of the FBRM can be found in U.S. Pat. No. 4,871,251. The mean chord length (MCL) of the PCC flocs is used as an overall measure of the extent of flocculation. The laser probe is inserted in a 600 mL beaker containing 300 mL of the 10% PCC slurry. The solution is stirred using an IKA RE16 stirring motor at 800 rpm for at least 30 seconds prior to the addition of flocculating agents.

The first flocculating agent is added slowly over the course of 30 seconds to 60 seconds using a syringe. When a second flocculating agent is used, it is added in a similar manner to the first flocculating agent after waiting 10 seconds for the first flocculating agent to mix. Finally, when a microparticle is added, it is added in a similar manner to the flocculating agents after waiting 10 seconds for the second flocculating agent to mix. Flocculants are diluted to a concentration of 0.3% based on solids, coagulants are diluted to a concentration of 0.7% based on solids, starch is diluted to a concentration of 5% based on solids, and microparticles are diluted to a concentration of 0.5% based on solids prior to use. A typical MCL time resolution profile is shown in FIG. 1.

The MCL time resolution profile of FIG. 1 was recorded by Lasentec® S400 FBRM. At point one, the first flocculating agent is introduced into the slurry and the MCL increases then quickly decreases under 800 rpm mixing speed, indicating that the filler flocs are not stable under the shear. At point two, the second flocculating agent is introduced, and the MCL also increases then decreases slightly under 800 rpm mixing. At point three, a microparticle is introduced and the MCL increases sharply then reaches a plateau, indicating that the filler flocs are stable under 800 rpm mixing. Once the shear is raised to 1500 rpm, MCL starts to decrease.

For every filler flocculation experiment, the maximum MCL after addition of the flocculating agent is recorded and listed in Table II. The maximum MCL indicates the extent of flocculation. The slurry is then stirred at 1500 rpm for 8 minutes to test the stability of the filler flocs under high shear conditions. The MCL values at 4 minutes and 8 minutes are recorded and listed in Tables III and IV, respectively.

The particle size distribution of the filler flocs is also characterized by laser light scattering using the Mastersizer Micro from Malvern Instruments Ltd., Southborough, MA USA. The analysis is conducted using a polydisperse model and presentation 4PAD. This presentation assumes a 1.60 refractive index of the filler and a refractive index of 1.33 for water as the continuous phase. The quality of the distribution is indicated by the volume-weighted median floe size, D(V,0.5), the span of the distribution, and the uniformity of the distribution. The span and uniformity are defined as:

$$\text{span} = \frac{D(V, 0.9) - D(V, 0.1)}{D(V, 0.5)}$$

$$\text{uniformity} = \frac{\sum V_i |D(V, 0.5) - D_i|}{D(V, 0.5) \sum V_i}$$

Here D(v,0.1), D(v,0.5) and D(v,0.9) are defined as the diameters that are equal or larger than 10%, 50% and 90% by volume of filler particles, respectively. $V_i$ and $D_i$ are the volume fraction and diameter of particles in size group i. Smaller span and uniformity values indicate a more uniform particle size distribution that is generally believed to have better performance in papermaking. These characteristics of filler flocs at maximum MCL, 4 minutes and 8 minutes under 1500 rpm shear are listed in Tables II, III and IV for each example. The PCC type, flocculating agents, and doses of flocculating agents used in each example are listed in Table I.

EXAMPLE 8

This experiment demonstrates the feasibility of using a continuous process to flocculate the PCC slurry. A batch of 18 liters of 10% solids undispersed PCC (available as Albacar HO from Specialty Minerals Inc., Bethlehem, Pa. USA) in tap water was pumped using a centrifugal pump at 7.6 L/min into a five gallon bucket. A 1.0 lb/ton active dose of 0.3% solids flocculant A solution was fed into the PCC slurry at the centrifugal pump inlet using a progressive cavity pump. The PCC was then fed into a static mixer together with 1.0 lb/ton active dose of a 0.7% solids solution of coagulant A. The size distribution of the filler flocs was measured using the Mastersizer Micro and reported in Table II. 300 mL of the resultant slurry was stirred in a beaker at 1500 rpm for 8 minutes in the same manner as in Examples 1-7. The characteristics of the filler flocs at 4 minutes and 8 minutes are listed in Tables III and IV, respectively.

EXAMPLE 9

The filler slurry and experimental procedure was the same as in Example 8, except that coagulant A was fed into the centrifugal pump and flocculant A was fed into the static mixer. The size characteristics of the filler flocs are listed in Tables II, III and IV.

TABLE I

PCC type, flocculating agent descriptions, and flocculating agent doses for examples 1 through 9.

| | | Polymer 1 | | Polymer 2 | | Microparticle | |
|---|---|---|---|---|---|---|---|
| Ex | PCC Type | Name | Dose (lb/ton) | Name | Dose (lb/ton) | Name | Dose (lb/ton) |
| 1 | Undispersed | Stalok 400 | 20 | None | | None | |
| 2 | Undispersed | Flocculant A | 1 | Coagulant A | 1 | None | |
| 3 | Undispersed | Coagulant A | 1 | Flocculant A | 1 | None | |
| 4 | Undispersed | Flocculant B | 1 | Coagulant B | 3 | B | 2 |
| 5 | Undispersed | Coagulant B | 3 | Flocculant B | 1 | B | 2 |
| 6 | Dispersed | Flocculant A | 1.5 | Coagulant A | 4 | None | |
| 7 | Dispersed | Coagulant A | 1 | Flocculant A | 1.5 | None | |
| 8 | Undispersed | Flocculant A | 1 | Coagulant A | 1 | None | |
| 9 | Undispersed | Coagulant A | 1 | Flocculant A | 1 | None | |

Stalok 400 Cationic starch available from Tate & Lyle, Decatur, IL USA

Flocculant A Anionic sodium acrylate-acrylamide copolymer flocculant with an RSV of about 32 dL/g and a charge content of 29 mole % available from Nalco Co., Naperville, IL USA.

Flocculant B Cationic acrylamide-dimethylaminoethyl methacrylate-methyl chloride quaternary salt copolymer flocculant with an RSV of about 25 dL/g and a charge content of 20 mole % available from Nalco Co., Naperville, IL USA.

Coagulant A Cationic poly(diallyldimethylammonium chloride) coagulant with an RSV of about 0.7 dL/g available from Nalco Co., Naperville, IL USA.

Coagulant B Anionic sodium acrylate-acrylamide copolymer with an RSV of about 1.8 dL/g and a charge content of 6 mole % available from Nalco Co., Naperville, IL USA.

Microparticle B Anionic colloidal borosilicate microparticle available from Nalco Co., Naperville, IL USA.

TABLE II

Characteristics of filler flocs at maximum MCL or 0 min under 1500 rpm shear.

| Example | MCL (μm) | D(v, 0.1) (μm) | D(v, 0.5) (μm) | D(v, 0.9) (μm) | Span | Uniformity |
|---|---|---|---|---|---|---|
| 1 | 12.52 | 10.42 | 23.07 | 46.48 | 1.56 | 0.49 |
| 2 | 16.81 | 13.48 | 32.08 | 98.92 | 2.66 | 0.83 |
| 3 | 30.13 | 53.94 | 130.68 | 228.93 | 1.34 | 0.41 |
| 4 | 18.52 | 19.46 | 43.91 | 90.86 | 1.63 | 0.51 |
| 5 | 38.61 | 67.2 | 147.73 | 240.04 | 1.17 | 0.36 |
| 6 | 34.39 | 53.21 | 111.48 | 209.04 | 1.40 | 0.43 |
| 7 | 45.63 | 34.17 | 125.68 | 240.63 | 1.64 | 0.52 |
| 8 | NA | 24.4 | 58.17 | 125.47 | 1.74 | 0.52 |
| 9 | NA | 29.62 | 132.79 | 234.62 | 1.54 | 0.46 |

TABLE III

Characteristics of filler flocs after 4 minutes under 1500 rpm shear.

| Example | MCL (μm) | D(v, 0.1) (μm) | D(v, 0.5) (μm) | D(v, 0.9) (μm) | Span | Uniformity |
|---|---|---|---|---|---|---|
| 1 | 7.46 | 4.76 | 9.51 | 17.39 | 1.33 | 0.41 |
| 2 | 13.21 | 11.29 | 27.26 | 91.78 | 2.95 | 0.92 |
| 3 | 16.13 | 13.25 | 42.73 | 142.37 | 3.02 | 0.92 |
| 4 | 13.86 | 14.91 | 28.46 | 51.63 | 1.29 | 0.4 |
| 5 | 17.66 | 21.8 | 58.08 | 143.31 | 2.09 | 0.65 |
| 6 | 14.77 | 15.77 | 35.62 | 85.29 | 1.95 | 0.6 |
| 7 | 21.26 | 12.88 | 45.00 | 197.46 | 4.10 | 1.24 |
| 8 | NA | 14.91 | 35.88 | 76.29 | 1.71 | 0.53 |
| 9 | NA | 8.08 | 48.64 | 152.89 | 2.98 | 0.93 |

TABLE IV

Characteristics of filler flocs after 8 minutes under 1500 rpm shear.

| Example | MCL (μm) | D(v, 0.1) (μm) | D(v, 0.5) (μm) | D(v, 0.9) (μm) | Span | Uniformity |
|---|---|---|---|---|---|---|
| 1 | 7.02 | 4.01 | 8.03 | 15 | 1.37 | 0.43 |
| 2 | 12.43 | 8.57 | 20.47 | 48.67 | 1.96 | 0.67 |
| 3 | 13.62 | 9.46 | 28.93 | 110.3 | 3.49 | 1.06 |
| 4 | 12.88 | 12.48 | 23.48 | 42.36 | 1.27 | 0.45 |
| 5 | 15.30 | 15.64 | 41.16 | 106.73 | 2.21 | 0.7 |
| 6 | 12.06 | 10.47 | 23.88 | 52.81 | 1.77 | 0.62 |
| 7 | 17.42 | 9.2 | 30.37 | 176 | 5.49 | 1.53 |
| 8 | NA | 12.67 | 30.84 | 65.95 | 1.73 | 0.53 |
| 9 | NA | 6.66 | 34.82 | 116.3 | 3.15 | 0.99 |

As shown in Tables II-IV, filler flocs formed in Example 1, where only cationic starch was used, are not shear stable. On the other hand, filler flocs formed by multiple polymers exhibit enhanced shear stability, as demonstrated in Examples 2 to 9. Examples 2, 4, 6 and 8 show filler flocs prepared according to this invention and Examples 3, 5, 7 and 9 show filler flocs prepared using existing methods. The filler flocs prepared according to the invention generally have narrower particle size distributions after being sheared down (as shown by the smaller values of span and uniformity in Tables III and IV) compared with those formed by existing methods.

EXAMPLE 10

The purpose of this example was to evaluate the effects of different sizes of PCC flocs on the physical properties of handsheets. The PCC samples were obtained using the procedure described in Example 2, except that the PCC solids level was 2%. Four samples of preflocculated filler flocs (10-A, 10-B, 10-C and 10-D) were prepared with different particle sizes by shearing at 1500 rpm for different times. The shear times and resulting particle size characteristics are listed in Table V.

Thick stock with a consistency of 2.5% was prepared from 80% hardwood dry lap pulp and 20% recycled fibers obtained from American Fiber Resources (AFR) LLC, Fairmont, W. Va. The hardwood was refined to a freeness of 300 mL Canadian Standard Freeness (TAPPI Test Method T 227 om-94) in a Valley Beater (from Voith Sulzer, Appleton, Wis.). The thick stock is diluted with tap water to 0.5% consistency.

Handsheets were prepared by mixing 650 mL of 0.5% consistency furnish at 800 rpm in a Dynamic Drainage Jar with the bottom screen covered by a solid sheet of plastic to prevent drainage. The Dynamic Drainage Jar and mixer are available from Paper Chemistry Consulting Laboratory, Inc., Carnel, NY. Mixing was started and 1 g of one of the PCC samples was added after 15 seconds, followed by 6 lb/ton (product based) of GC7503 polyaluminum chloride solution (available from Gulbrandsen Technologies, Clinton, NJ, USA) at 30 seconds, 1 lb/ton (product based) of a sodium acrylate-acrylamide copolymer flocculant with an RSV of about 32 dL/g and a charge content of 29 mole % (available from Nalco Company, Naperville, Ill. USA) at 45 seconds, and 3.5 lb/ton (active) of a borosilicate microparticle (available from Nalco Company, Naperville, Ill. USA) at 60 seconds.

Mixing was stopped at 75 seconds and the furnish was transferred into the deckle box of a Noble & Wood handsheet mold. The 8"×8" handsheet was formed by drainage through a 100 mesh forming wire. The handsheet was couched from the sheet mold wire by placing two blotters and a metal plate on the wet handsheet and roll-pressing with six passes of a 25 lb metal roller. The forming wire and one blotter were removed and the handsheet was placed between two new blotters and the press felt and pressed at 50 psig using a roll press. All of the blotters were removed and the handsheet is dried for 60 seconds (top side facing the dryer surface) using a rotary drum drier set at 220° F. The average basis weight of a handsheet was 84 g/m$^2$. The handsheet mold, roll press, and rotary drum dryer are available from Adirondack Machine Company, Queensbury, NY. Five replicate handsheets are produced for each PCC sample tested.

The finished handsheets were stored overnight at TAPPI standard conditions of 50% relative humidity and 23° C. For each sheet, the basis weight was determined using TAPPI Test Method T 410 om-98, the ash content was determined using TAPPI Test Method T 211 om-93, brightness is determined using ISO Test Method 2470:1999, and opacity was determined using ISO Test Method 2471:1998. Sheet formation, a measure of basis weight uniformity, was determined using a Kajaani® Formation Analyzer from Metso Automation, Helsinki, FI. The results from these measurements are listed in Table VI. The tensile strength of the sheets was measured using TAPPI Test Method T 494 om-01, Scott Bond was measured using TAPPI Test Method T 569 pm-00, and z-directional tensile strength (ZDT) was measured using TAPPI Test Method T 541 om-89. These results are listed in Table VII.

TABLE V

Filler floc size characteristics for samples 10-A through 10-E. The 10-E sample is an untreated PCC slurry.

| Example | Shear Time (s) | MCL (μm) | D(v, 0.1) (μm) | D(v, 0.5) (μm) | D(v, 0.9) (μm) | Span | Uniformity |
|---|---|---|---|---|---|---|---|
| 10-A | 210 | 70.4 | 30.4 | 83.6 | 181.2 | 1.8 | 0.55 |
| 10-B | 330 | 49.3 | 29.2 | 64.0 | 129.1 | 1.6 | 0.49 |
| 10-C | 450 | 39.4 | 22.5 | 45.1 | 87.4 | 1.4 | 0.44 |
| 10-D | 1500 | 29.8 | 13.8 | 25.8 | 46.3 | 1.3 | 0.39 |

TABLE V-continued

Filler floc size characteristics for samples 10-A through 10-E. The 10-E sample is an untreated PCC slurry.

| Example | Shear Time (s) | MCL (μm) | D(v, 0.1) (μm) | D(v, 0.5) (μm) | D(v, 0.9) (μm) | Span | Uniformity |
|---|---|---|---|---|---|---|---|
| 10-E | NA | 9.24 | 0.64 | 1.54 | 3.28 | 1.7 | 0.66 |

TABLE VI

The optical properties of sheets with different size filler flocs.

| PCC from Ex. No. | Basis weight ($g/m^2$) | Ash content (%) | Opacity at 60 $g/m^2$ (% ISO) | Brightness (% ISO) | Formation Index |
|---|---|---|---|---|---|
| 10-A | 84.3 | 15.0 | 89.6 | 87.8 | 87.6 |
| 10-B | 83.8 | 13.3 | 89.1 | 87.8 | 93.3 |
| 10-C | 84.6 | 14.4 | 89.6 | 87.9 | 94.3 |
| 10-D | 83.5 | 13.9 | 89.8 | 87.8 | 102.6 |
| 10-E | 83.0 | 14.5 | 92.8 | 87.6 | 101.2 |

TABLE VII

Mechanical strength properties of sheets with different size filler flocs.

| | Mechanical Strength | | | | Improvement (%) | | | |
|---|---|---|---|---|---|---|---|---|
| PCC from Ex. No. | ZDT (kPa) | Scott Bond (psi) | Tensile Index (N · m/g) | TEA (N · cm/$cm^2$) | ZDT | Scott Bond | Tensile Index | TEA |
| 10-A | 733.2 | 226.3 | 82.9 | 2.6 | 14 | 26 | 3.8 | 44 |
| 10-B | 709.7 | 254.8 | 81.7 | 2.2 | 10 | 52 | 2.3 | 20 |
| 10-C | 675.9 | 217.2 | 83.0 | 2.5 | 4.8 | 29 | 3.9 | 36 |
| 10-D | 681.4 | 219.6 | 85.5 | 2.3 | 5.7 | 31 | 7.0 | 30 |
| 10-E | 644.9 | 179.0 | 79.9 | 1.8 | 0 | 0 | 0 | 0 |

As shown in Table V, the size of the filler flocs decreases as the time under 1500 rpm shear increases, demonstrating the feasibility of controlling the size of filler flocs by the time under high shear. Handsheets prepared from each of the four preflocculated fillers (10-A through 10-D) and the untreated filler (10-E) have roughly equivalent ash contents and basis weight, as listed in Table VI. Increasing the floe size did not hurt brightness, but decreased the formation and opacity of the sheets slightly. The mechanical strength of the sheets, as measured by z-directional tensile strength, Scott Bond, tensile index, and tensile energy absorption (TEA) increased significantly with increasing filler floc size. This is shown in Table VII. In general, higher median PCC floc size lead to increased sheet strength. In practice, the slight loss of opacity could be compensated for by increasing the PCC content of the sheet at constant to improved sheet strength.

In at least one embodiment, a method of preflocculating filler particles for use in papermaking processes comprises: a) providing an aqueous slurry of filler particles; b) adding a first flocculating agent to the dispersion under conditions of high mixing; d) adding a second flocculating agent under conditions of high mixing in an amount sufficient to initiate flocculation of the filler particles in the presence of the first flocculating agent; and e) optionally shearing the flocculated dispersion to provide a dispersion of filler flocs having the desired particle size. Preferably, the first flocculating agent is one of the previously described anionic flocculants. Preferably, the second flocculating agent is one of the previously described cationic flocculants. The two flocculants may each have a high molecular weight and low to medium charge density.

Without being limited by theory or design it is believed that the first high molecular weight flocculating agent forms an evenly distributed mixture through the slurry before absorption. This evenly distributed mixture aids the cationic second flocculating agent in efficiently pulling together the mass to form the floc particles. As the following examples demonstrate, this embodiment's novel use of two high molecular weight flocculating agents to control the particle size distribution through the slurry produces unexpectedly efficient floe production. This embodiment can best be understood with reference to Examples 11-16.

EXAMPLE 11-12

Scalenohedral PCC (available as Syncarb S NY from Omya) was diluted to 10% solids using tap water. The size distribution of the filler was measured at three second intervals during flocculation using a Lasentec® S400 FBRM. The laser probe was inserted in a 600 mL beaker containing 300 mL of the 10% PCC slurry. The solution was stirred using an IKA RE16 stirring motor at 800 rpm for at least 30 seconds prior to the addition of flocculating agents.

The first flocculating agent was added, as a dilute solution, slowly over the course of several minutes using a syringe. When a second flocculating agent is used, it was added in a similar manner to the first flocculating agent after waiting 10 seconds for the first flocculating agent to mix. The slurry is then stirred at 1500 rpm for 2-4 minutes to test the stability of the filler flocs under high shear conditions. The PCC type, flocculating agents, and doses of flocculating agents used in these examples are listed in Table VIII, and the resulting characterization of the particles is given in Table IX.

EXAMPLES 13-16

This experiment demonstrated the feasibility of using a continuous process to flocculate the PCC slurry. A batch of 18 liters of 10% solids undispersed PCC (available as Albacar HO from Specialty Minerals Inc., Bethlehem, Pa. USA) in tap water is pumped using a centrifugal pump at 7.2 kg PCC/min into a five gallon bucket. The appropriate dosage of the first flocculating agent solution is fed into the PCC slurry at the centrifugal pump inlet using a progressive cavity pump. The PCC is then fed into a static mixer together with the appropriate dosage of the second flocculating agent. The size distribution of the filler flocs is measured using the Mastersizer Micro and reported in Table X. The resulting sample is exposed to additional shear by circulating the sample through a centrifugal pump; the results are also given in Table X.

The results shown in Tables IX-X highlight the advantages of the dual flocculant treatment. Examples 12, 14-16 demonstrate improved shear stability as indicated by a lower volume percent of particles with size less than 10 micron. These samples were found to be superior to Examples 11 and 13.

TABLE VIII

Calcium carbonate type, flocculating agent descriptions, and flocculating agent doses for examples.

| | | Polymer 1 | | Polymer 2 | | Microparticle | |
|---|---|---|---|---|---|---|---|
| Ex | Calcium carbonate Type | Name | Dose (lb/ton) | Name | Dose (lb/ton) | Name | Dose (lb/ton) |
| 11 | Undispersed PCC | Flocculant A | 2 | Coagulant A | 1 | None | |
| 12 | Undispersed PCC | Flocculant A | 1.5 | Flocculant B | 1.5 | None | |
| 13 | Undispersed PCC | Flocculant A | 1.5 | Coagulant A | 1.5 | None | |
| 14 | Undispersed PCC | Flocculant A | 1 | Flocculant B | 1 | None | |
| 15 | Undispersed PCC | Flocculant A | 1 | Flocculant C | 1 | A | 1 |
| 16 | Undispersed PCC | Flocculant A | 1 | Flocculant B | 1 | A | 1 |

Flocculant A Anionic sodium acrylate-acrylamide copolymer flocculant with an RSV of about 32 dL/g and a charge content of 29 mole % available from Nalco Co., Naperville, IL USA.
Flocculant B Cationic acrylamide-dimethylaminoethyl acrylate-methyl chloride quaternary salt copolymer flocculant with a RSV of about 25 dL/g and a charge content of 10 mole % available from Nalco Co., Naperville, IL USA.
Flocculant C Cationic acrylamide-dimethylaminoethyl acrylate-methyl chloride quaternary salt copolymer flocculant with a RSV of about 25 dL/g and a charge content of 20 mole % available from Nalco Co., Naperville, IL USA.
Coagulant A Cationic poly(diallyldimethylammonium chloride) coagulant with an RSV of about 0.7 dL/g available from Nalco Co., Naperville, IL USA.
Microparticle A Anionic colloidal borosilicate microparticle available from Nalco Co., Naperville, IL USA.

TABLE IX

Characteristics of flocculated calcium carbonate samples in Examples 11-12 as prepared at 800 rpm and upon subsequent shear under 1500 rpm.

| Ex | Time at 1500 rpm (min) | D(v, 0.1) (μm) | D(v, 0.5) (μm) | D(v, 0.9) (μm) | Vol % <10 (μm) | Span |
|---|---|---|---|---|---|---|
| 11 | 0 | 28.6 | 70.9 | 149.4 | 0.9 | 1.7 |
| 12 | 0 | 55.4 | 109.1 | 201.9 | 0.2 | 1.3 |
| 11 | 2 | 14.4 | 37.7 | 87.5 | 3.8 | 1.9 |
| 12 | 2 | 20.3 | 45.3 | 94.1 | 1.3 | 1.6 |
| 11 | 4 | 11.4 | 28.6 | 70.0 | 6.7 | 2.0 |
| 12 | 4 | 14.9 | 33.8 | 73.4 | 2.9 | 1.7 |

TABLE X

Characteristics of flocculated calcium carbonate samples in Examples 13-16.

| Ex | No. circulations through pump | D(v, 0.1) (μm) | D(v, 0.5) (μm) | D(v, 0.9) (μm) | Vol % <10 (μm) | Span |
|---|---|---|---|---|---|---|
| 13 | 0 | 18.6 | 36.8 | 68.6 | 1.47 | 1.36 |
| 14 | 0 | 57.3 | 115.0 | 211.5 | 0.18 | 1.34 |
| 15 | 0 | 49.1 | 99.6 | 192.0 | 0.62 | 1.43 |
| 16 | 0 | 36.8 | 76.2 | 148.6 | 0.77 | 1.47 |
| 13 | 3 | 10.9 | 21.5 | 39.6 | 6.94 | 1.34 |
| 14 | 3 | 23.7 | 45.1 | 81.1 | 1.22 | 1.27 |
| 15 | 3 | 17.3 | 34.5 | 63.7 | 2.04 | 1.35 |
| 16 | 3 | 16.0 | 35.2 | 69.0 | 2.83 | 1.51 |
| 13 | 6 | 9.0 | 18.0 | 33.3 | 12.44 | 1.35 |
| 14 | 6 | 16.7 | 32.2 | 58.3 | 1.76 | 1.29 |
| 15 | 6 | 12.2 | 26.0 | 51.1 | 5.26 | 1.50 |
| 16 | 6 | 13.7 | 30.1 | 59.0 | 4.14 | 1.51 |

TABLE X-continued

Characteristics of flocculated calcium carbonate samples in Examples 13-16.

| Ex | No. circulations through pump | D(v, 0.1) (μm) | D(v, 0.5) (μm) | D(v, 0.9) (μm) | Vol % <10 (μm) | Span |
|---|---|---|---|---|---|---|
| 13 | 9 | 8.0 | 16.2 | 30.0 | 17.28 | 1.36 |
| 14 | 9 | 14.0 | 27.3 | 49.9 | 2.89 | 1.31 |
| 15 | 9 | 10.2 | 21.7 | 42.3 | 8.87 | 1.48 |
| 16 | 9 | 11.7 | 26.2 | 52.1 | 6.27 | 1.54 |

At least one embodiment is a method of preflocculating filler that has been dispersed using a high charge, low molecular weight, anionic dispersing agent. The method consists of a) providing an aqueous slurry of anionically dispersed filler particles; b) adding a low molecular weight coagulant to the dispersion in order to completely or partially neutralize the charge in the system; c) adding a first flocculating agent to the dispersion under conditions of high mixing; d) adding a second flocculating agent (can be a coagulant or flocculant) to the dispersion under conditions of high mixing; and e) optionally shearing the flocculated dispersion to provide a dispersion of filler flocs having the desired particle size.

Preferably, the low molecular weight, charge-neutralizing component is a coagulant, as previously described. Preferably, the first flocculating agent is an anionic or cationic flocculant, as previously described. Preferably, the second flocculating agent is either a coagulant or a flocculant with the opposite charge of the first flocculating agent. This can best be understood with reference to the following Examples 17-20:

EXAMPLES 17-20

The dispersed ground calcium carbonate (GCC) used in the examples is either Hydrocarb HO G-NE or Omyafil 90 from Omya. The dispersed GCC, obtained as a 65% solids slurry, is diluted to 10% solids using tap water. The size distribution of the filler is measured at three second intervals during flocculation using a Lasentec® S400 FBRM (Focused Beam Reflectance Measurement) probe, as described in Examples 1-7. The laser probe is inserted in a 600 mL beaker containing 300 mL of the 10% PCC slurry. The solution is stirred using an IKA RE 16 stirring motor at 800 rpm for at least 30 seconds prior to the addition of flocculating agents.

The neutralizing polymer is added slowly over the course of approximately a few minutes. The first flocculating agent is then added slowly over the course of several minutes using a syringe. When a second flocculating agent is used, it is added in a similar manner to the first flocculating agent after waiting 10 seconds for the first flocculating agent to mix. The slurry is then stirred at 1500 rpm for 2-4 minutes to test the stability of the filler flocs under high shear conditions.

TABLE XI

Ground calcium carbonate source, flocculating agent descriptions, and flocculating agent doses for examples 17-20.

| Ex | Source of Dispersed Ground Calcium Carbonate | Polymer A Name | Polymer A Dose (lb/ton) | Polymer 1 Name | Polymer 1 Dose (lb/ton) | Polymer 2 Name | Polymer 2 Dose (lb/ton) |
|---|---|---|---|---|---|---|---|
| 17 | Hydrocarb HO G-ME | None | | Coagulant A | 4 | Flocculant A | 1.5 |
| 18 | Hydrocarb HO G-ME | Coagulant A | 4 | Flocculant A | 1.5 | Coagulant A | 1 |
| 19 | Hydrocarb HO G-ME | None | | Coagulant B | 2 | Flocculant B | 1.4 |
| 20 | Omyafil 90 | Coagulant A | 1.5 | Flocculant A | 1 | Coagulant A | 0.5 |

Flocculant A Anionic sodium acrylate-acrylamide copolymer flocculant with an RSV of about 32 dL/g and a charge content of 29 mole % available from Nalco Co., Naperville, IL USA.

Flocculant B Cationic acrylamide-dimethylaminoethyl acrylate-methyl chloride quaternary salt copolymer flocculant with an RSV of about 25 dL/g and a charge content of 10 mole % available from Nalco Co., Naperville, IL USA.

Coagulant A Cationic poly(diallyldimethylammonium chloride) coagulant with an RSV of about 0.7 dL/g available from Nalco Co., Naperville, IL USA.

Coagulant B Cationic epichlorohydrin-dimethylamine copolymer crosslinked with ammonia with a RSV of about 0.3 dL/g available from Nalco Co., Naperville, IL, USA.

TABLE XII

Characteristics of flocculated ground calcium carbonate samples in Example 17-20 as prepared at 800 rpm and upon subsequent shear under 1500 rpm.

| Ex | Time at 1500 rpm | D(v, 0.1) | D(v, 0.5) | D(v, 0.9) | Vol % <10 um | Span |
|---|---|---|---|---|---|---|
| 17 | 0 | 12.2 | 35.1 | 113.2 | 5.2 | 2.9 |
| 18 | 0 | 59.9 | 139.5 | 235.9 | 0.0 | 1.3 |
| 19 | 0 | 24.9 | 101.8 | 211.9 | 2.1 | 1.8 |
| 20 | 0 | 27.4 | 77.4 | 171.3 | 0.3 | 1.9 |
| 17 | 2 mins. | 8.4 | 21.5 | 62.6 | 14.0 | 2.5 |
| 18 | 2 mins. | 34.7 | 74.2 | 148.7 | 0.6 | 1.5 |
| 19 | 2 mins. | 7.5 | 36.1 | 130.6 | 13.9 | 3.4 |
| 20 | 2 mins. | 18.4 | 45.3 | 101.9 | 1.4 | 1.8 |

TABLE XII-continued

Characteristics of flocculated ground calcium carbonate samples in Example 17-20 as prepared at 800 rpm and upon subsequent shear under 1500 rpm.

| Ex | Time at 1500 rpm | D(v, 0.1) | D(v, 0.5) | D(v, 0.9) | Vol % <10 um | Span |
|---|---|---|---|---|---|---|
| 18 | 4 mins. | 27.6 | 57.6 | 46.8 | 0.7 | 0.3 (mistake here) |
| 20 | 4 mins. | 14.6 | 35.9 | 84.2 | 3.2 | 1.9 |
| 18 | 8 mins. | 22.6 | 46.9 | 91.7 | 0.7 | 1.5 |

As shown in Table XI, Examples 18 and 20 demonstrate the invention disclosed, namely, an initial treatment with a charge-neutralizing polymer followed by two flocculating polymers. Examples 17 and 19 represent the use of a coagulant followed by a flocculant. As shown in Table XII, the preflocculated GCC in Examples 18 and 20 show improved shear stability indicated by larger median particle size D(v, 0.5) at the same amount of shear. Examples 18 and 20 also have an improved particle size distribution, indicated by smaller span and lower percent by volume less than 10 microns.

EXAMPLE 21

The purpose of these examples was to evaluate the impact of the preflocculated ground calcium carbonate on the physical properties of paper sheets. The preflocculated sample from Example 20 was used for this purpose, and compared against untreated Omyafil 90.

Thick stock with a consistency of 2.3% was prepared from 75% hardwood dry lap pulp and 25% softwood dry lap pulp. Both woods were refined to a freeness of 400 mL Canadian Standard Freeness (TAPPI Test Method T 227 om-94) in a Valley Beater (from Voith Sulzer, Appleton, Wis.). The thick stock was diluted with tap water to 0.5% consistency.

Handsheets were prepared by mixing 650 mL of 0.5% consistency furnish at 800 rpm in a Dynamic Drainage Jar with the bottom screen covered by a solid sheet of plastic to prevent drainage. The Dynamic Drainage Jar and mixer are available from Paper Chemistry Consulting Laboratory, Inc., Carmel, NY. Mixing was started and the GCC sample was added, followed by 11 lb/ton cationic starch and 3 lb/ton of Nalco 7542 sizing agent at 15 seconds, and finally 0.6 lb/ton (product based) of a sodium acrylate-acrylamide copolymer flocculent with an RSV of about 32 dL/g and a charge content of 29 mole % (available from Nalco Company, Naperville, Ill.).

Mixing was stopped at 45 seconds and the furnish was transferred into the deckle box of a Noble & Wood handsheet mold. The 8"×8" handsheet was formed by drainage through a 100 mesh forming wire. The handsheet was couched from the sheet mold wire by placing two blotters and a metal plate on the wet handsheet and roll-pressing with six passes of a 25 lb metal roller. The forming wire and one blotter were removed and the handsheet was placed between two new blotters and the press felt and pressed at 50 psig using a flat press. All of the blotters were removed and the handsheet was dried for 60 seconds (top side facing the dryer surface) using a rotary drum drier set at 220° F. The handsheet mold, roll press, and rotary drum dryer are available from Adirondack Machine Company, Glens Falls, NY. Five replicate handsheets were produced for each PCC sample tested.

The finished handsheets were stored overnight at TAPPI standard conditions of 50% relative humidity and 23° C. The basis weight (TAPPI Test Method T 410 om-98), ash content (TAPPI Test Method T 211 om-93) for determination of PCC content, brightness (ISO Test Method 2470:1999), opacity (ISO Test Method 2471:1998), formation, tensile strength (TAPPI Test Method T 494 om-01), Scott Bond (TAPPI Test Method T 569 pm-00), and z-directional tensile strength (ZDT, TAPPI Test Method T 541 om-89) of the handsheets were tested. The formation, a measure of basis weight uniformity, was determined using a Kajaani® Formation Analyzer from Metso Automation, Helsinki, FI.

TABLE XII

Properties of sheets containing untreated ground calcium carbonate or a preflocculated sample as described in Example 20.

| GCC source | Basis weight ($g/m^2$) | Ash content % | ZDT (kPa) | Tensile Index (Nm/g) | TEA ($J/m^2$) |
|---|---|---|---|---|---|
| Omyafil 90 | 86.0 | 12.6 | 562 | 49.3 | 135 |
| Omyafil 90 | 81.4 | 18.4 | 553 | 44.0 | 102 |
| Example 20 | 91.4 | 17.8 | 608 | 53.7 | 163 |
| Example 20 | 91.4 | 27.7 | 598 | 45.4 | 129 |

The mechanical strength data in Table XII indicates a 20% increase in tensile index and 10% increase in internal bond strength at a level 18% ash for the sheets containing the preflocculated filler produced in Example 20, compared to the sheets containing untreated GCC.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. Furthermore, the invention encompasses any and all possible combinations of some or all of the various embodiments described herein. Any and all patents, patent applications, scientific papers, and other references cited in this application are hereby incorporated by reference in their entirety.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

The invention claimed is:

1. A method of preparing a stable dispersion of flocculated filler particles having a specific particle size distribution for use in papermaking processes comprising:

a) providing an aqueous dispersion of filler particles;

b) adding a first flocculating agent to the dispersion in an amount sufficient to mix uniformly in the dispersion without causing significant flocculation of the filler particles, the first flocculating agent being a flocculant, being anionic and having an RSV of at least 10 dL/g wherein there are no paper fibers present in the dispersion;

c) adding a second flocculating agent to the dispersion after adding the first flocculating agent, in an amount sufficient to initiate flocculation of the filler particles in the presence of the first flocculating agent, the second flocculating agent being of opposite charge to the first flocculating agent and being cationic;

d) shearing the flocculated dispersion to provide a dispersion of filler flocs having the desired particle size; and e) steps a) through d) are performed prior to adding the dispersion of filler flocs to paper fibers.

2. The method of claim 1 wherein the filler flocs have a median particle size of 10-100 μm.

3. The method of claim 1 wherein the filler is selected from the group consisting of calcium carbonate, kaolin clay, talc, titanium dioxide, alumina trihydrate, barium sulfate and magnesium hydroxide.

4. The method of claim 1 wherein the second flocculating agent is a flocculant and has an RSV of at least 2 dL/g.

5. The method of claim 4 wherein the filler flocs have a median particle size of 10-100 μm.

6. The method of claim 1 wherein the filler is ground calcium carbobnate.

7. The method of claim 1 wherein the first flocculating agent is a copolymer of acrylamide and sodium acrylate.

8. The method of claim 1 wherein the second flocculating agent is selected from the list consisting of copolymers of acrylamide with DMAEM, DMAEA, DEAEA, DEAEM.

9. The method of claim 8 in which the second flocculating agent is in quaternary ammonium salt form made with a salt selected from the list consisting of dimethyl sulfate, methyl chloride, benzyl chloride, and any combination thereof.

10. A method of preparing a stable dispersion of flocculated filler particles that has been dispersed using a high charge for use in papermaking processes comprising:

a) providing an aqueous slurry of anionically dispersed filler particles wherein there are no paper fibers present in the dispersion;

b) adding a low molecular weight composition to the dispersion, the added low molecular weight composition at least partially neutralizing the charge in the dispersion;

c) adding a first flocculating agent to the dispersion under conditions of a mixing speed of up to 800 RPM;

d) adding a second cationic flocculating agent to the dispersion under conditions of high speed mixing, second flocculating agent comprising an item selected from the list consisting of a flocculent, a coagulant, a microparticle, and any combination thereof;

e) shearing the flocculated dispersion under conditions of a mixing speed up to 1500 RPM to provide a dispersion of filler flocs having the desired particle size; and f) steps a) through e) are performed prior to adding the dispersion of filler flocs to paper fibers.

11. The method of claim 10 in which the low molecular weight composition is a coagulant.

12. The method of claim 10 wherein the filler flocs have a median particle size of 10-100 μm.

13. The method of claim 10 wherein the filler is selected from the group consisting of calcium carbonate, kaolin clay, talc, titanium dioxide, alumina trihydrate, barium sulfate and magnesium hydroxide.

14. The method of claim 10 wherein the low molecular weight composition is a cationic coagulant, the first flocculating agent is an anionic flocculent, the second flocculating agent is a cationic flocculent, and both flocculants have a molecular weight of at least 1,000,000.

* * * * *